US010067443B2

(12) United States Patent
Noguchi et al.

(10) Patent No.: US 10,067,443 B2
(45) Date of Patent: Sep. 4, 2018

(54) DEVELOPER CONTAINER, DEVELOPING DEVICE, PROCESS CARTRIDGE, AND IMAGE FORMING APPARATUS INCORPORATING A DEVELOPER QUANTITY DETECTION UNIT

(71) Applicant: CANON KABUSHIKI KAISHA, Tokyo (JP)

(72) Inventors: Bunro Noguchi, Suntou-gun (JP); Takayoshi Kihara, Mishima (JP); Go Shindo, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/492,999

(22) Filed: Sep. 22, 2014

(65) Prior Publication Data

US 2015/0086226 A1 Mar. 26, 2015

(30) Foreign Application Priority Data

Sep. 24, 2013 (JP) ..... 2013-197217

(51) Int. Cl.
*G03G 15/08* (2006.01)

(52) U.S. Cl.
CPC ..... *G03G 15/0889* (2013.01); *G03G 15/086* (2013.01)

(58) Field of Classification Search
CPC ..... G03G 15/05824; G03G 15/0825; G03G 15/0829; G03G 15/0831; G03G 15/086; G03G 15/0889; G03G 2215/0888
USPC ..... 399/27, 61, 63, 260
See application file for complete search history.

(56) References Cited

U.S. PATENT DOCUMENTS

| | | | | |
|---|---|---|---|---|
| 6,148,156 | A * | 11/2000 | Matsumoto | 399/30 |
| 6,208,817 | B1 * | 3/2001 | Chadani | G03G 15/0942 399/104 |
| 6,415,111 | B1 * | 7/2002 | Higeta | 399/27 |
| 2001/0051051 | A1 * | 12/2001 | Matsumoto | 399/13 |
| 2003/0161644 | A1 * | 8/2003 | Yokoi et al. | 399/27 |
| 2003/0219265 | A1 * | 11/2003 | Matsumoto et al. | 399/38 |
| 2009/0010659 | A1 * | 1/2009 | Watanabe | 399/27 |
| 2009/0154942 | A1 * | 6/2009 | Hotogi et al. | 399/27 |
| 2009/0169241 | A1 * | 7/2009 | Mimura | G03G 15/0875 399/106 |
| 2011/0182605 | A1 * | 7/2011 | Otsuka et al. | 399/55 |
| 2015/0016829 | A1 * | 1/2015 | Watanabe | G03G 15/0865 399/27 |
| 2015/0016830 | A1 * | 1/2015 | Matsumaru et al. | 399/27 |

FOREIGN PATENT DOCUMENTS

| | | | |
|---|---|---|---|
| JP | 09190067 | A | 7/1997 |
| JP | 2007264612 | A | 10/2007 |

* cited by examiner

*Primary Examiner* — David M Gray
*Assistant Examiner* — Andrew V Do
(74) *Attorney, Agent, or Firm* — Canon U.S.A., Inc. IP Division

(57) ABSTRACT

A developer container includes a stirring member that stirs a developer and a conductive resin sheet that comes into contact with the stirring member when the stirring member rotates. Wherein, the developer container detects developer quantity using capacitance from the conductive resin sheet.

23 Claims, 7 Drawing Sheets

DEVELOPER CONTAINER, DEVELOPING DEVICE, PROCESS CARTRIDGE, AND IMAGE FORMING APPARATUS INCORPORATING A DEVELOPER QUANTITY DETECTION UNIT

BACKGROUND

Field

Aspects of the present invention generally relate to technology for detecting amount of developer by detecting change in capacitance.

Description of the Related Art

Many electrophotographical image forming apparatuses have remaining toner quantity detection units for notifying the user in a case where developer (hereinafter, "toner") has been consumed. One method of remaining toner quantity detection involves detecting toner quantity by detecting change in capacitance between multiple electrodes disposed within a developing container. The configuration of these electrodes generally follows an electrode plate detection method where an electrode plate is disposed with a predetermined interval as to a developer bearing member (another electrode), and detecting capacitance between the electrode plate and the developer bearing member.

There has also been proposed a method to make comparison with a comparison circuit to improve accuracy of remaining toner quantity detection, such as described in Japanese Patent Laid-Open No. 9-190067. There has also been proposed a method where a comparison circuit is provided, and further a stirring cycle is also taken into consideration, such as described in Japanese Patent Laid-Open No. 2007-264612. However, these devices to detect remaining quantity of toner are costly. Accordingly, there has been demand for further reduction of cost.

SUMMARY

An aspect of the present disclosure is generally related to a developer container including a stirring member configured to stir the developer, and a conductive resin sheet disposed so as to come into contact with the stirring member when the stirring member rotates, and configured to detect developer quantity using capacitance. At least part of a side face of the conductive resin sheet situated on the upstream side thereof in the direction of rotation of the stirring member is fixed to the developer container.

Further features of the present disclosure will become apparent from the following description of exemplary embodiments with reference to the attached drawings.

DESCRIPTION OF THE EMBODIMENTS

First Embodiment

Description of Image Forming Apparatus and Image Forming Process

Figure 2:
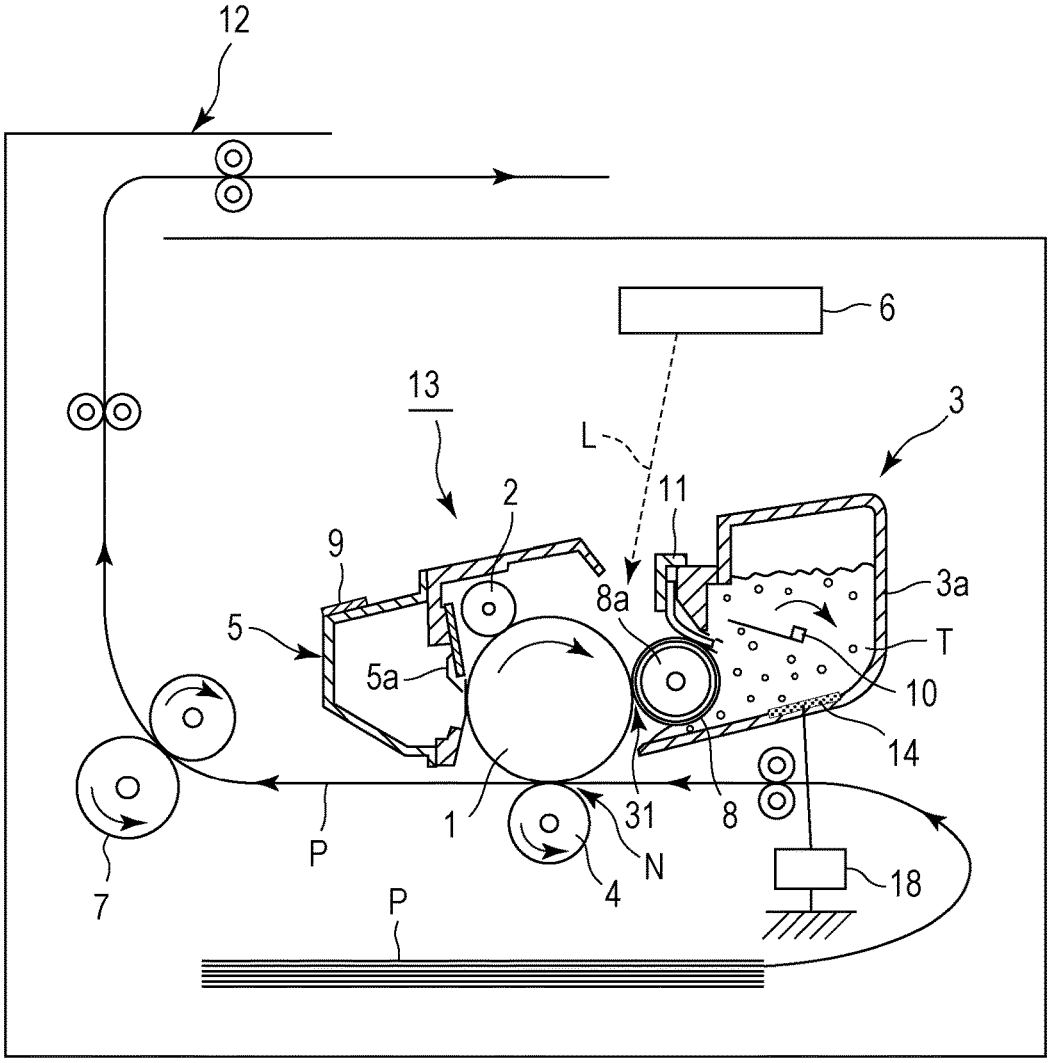
FIG. 2 is a schematic configuration diagram of an image forming apparatus having a developing device according to the first embodiment.

FIG. 2 illustrates a schematic configuration of an electrophotographical laser beam printer, which is an embodiment of an image forming apparatus according to the present disclosure.

An image forming apparatus 12 according to the present embodiment using electrophotographical technology has a drum-shaped electrophotographical photosensitive member (hereinafter, "photosensitive drum") 1, serving as an image bearing member. Disposed around the photosensitive drum 1 are, in the order following rotation of the photosensitive drum 1, a charging roller 2, a beam scanner unit 6, a developing device 3, a transfer roller 4, and a cleaning device 5. A fixing device 7 is disposed on the downstream side of a transfer nip N in the conveyance direction of a transfer medium. The transfer nip N is formed between the photosensitive drum 1 and the transfer roller 4 serving as a transfer device.

Detailed Description of Image Forming Apparatus

The photosensitive drum 1 according to the present embodiment has an organic photoconductor (OPC) photosensitive layer upon an aluminum drum base member, and is rotationally driven in the direction indicated by the arrow in FIG. 2 (clockwise direction) at a predetermined peripheral speed, by a driving unit (not shown) provided to the image forming apparatus main body.

The charging roller 2 serving as a charging unit uniformly charges the photosensitive drum 1 to a predetermined polarity and potential, by a charging bias applied from a charging bias power source (not shown). For the charging bias, a 1.6 kV AC voltage Vpp sufficient to discharge the charging roller 2, and a −560 V DC voltage Vdc equivalent to the dark potential Vd on the photosensitive drum 1, are superimposed. The frequency thereof is 1600 Hz. The AC component of the charging bias is subjected to constant current control so that a constant current always flows between the photosensitive drum 1 and the charging roller 2.

The beam scanner unit 6 outputs a laser beam (exposure laser beam L) from a laser output unit (not shown). The exposure laser beam L has been modulated corresponding to time-sequence electric digital image signals by a video controller (not shown) in accordance with image information input from a personal computer (not shown) or the like. The exposure laser beam L performs scanning exposure of the surface of the charged photosensitive drum 1, thereby forming an electrostatic latent image corresponding to the image information. The exposure laser beam L is irradiated in the present embodiment such that the bright potential V1 on the photosensitive drum 1 is −130 V.

The developing device 3, a voltage applying unit 15, and a remaining developer detection unit (remaining toner detection unit) 17 will be described later in detail.

The transfer roller 4 serving as a transfer unit forms the transfer nip N by being pressed against the surface of the photosensitive drum 1 by a predetermined pressing force. A transfer bias is applied to the transfer roller 4 from a transfer bias power source (not shown). This transfer bias transfers the developer image (toner image) on the surface of the photosensitive drum 1 onto a transfer medium P such as a sheet or the like, at the transfer nip N of the transfer roller 4 and photosensitive drum 1.

The fixing device 7 has a heating roller with a halogen heater (not shown), and a pressurizing roller. The transfer medium P is pinched and conveyed through the fixing nip of a fixing roller and pressurizing roller, where the toner image which has been transferred onto the surface of the transfer medium P is thermally fixed by heating to the point of fusing, and pressurizing. The image is thus fixed to the transfer medium P, which is then externally discharged from the image forming apparatus 12.

A cleaning blade 5*a* serving as a cleaning member cleans residual developer (toner) that was not transferred off of photosensitive drum 1, so that the photosensitive drum 1 is ready to perform image forming again.

Note that the photosensitive drum 1, charging roller 2, developing device 3, and cleaning blade 5*a* integrally make up a process cartridge 13, which is detachably mounted to the image forming apparatus main body.

Details of Developing Device

The developing device 3 will be described in detail with reference to FIG. 3. The developing device 3 includes a developing container 3*a* which accommodates developer (hereinafter, "toner T"), and a stirring member 10 which has a sheet member 10*b* to stir the toner T. Also included in the developing device 3 are a developing sleeve 8 serving as a developer bearing member, a magnet roller 8*a* within the developing sleeve 8, a developing blade 11 to restrict the layer thickness of the toner T, and an antenna member 14 to detect remaining developer quantity (hereinafter, "remaining toner quantity").

While the present embodiment will be described as using magnetic single-component toner T with an average particle diameter of 7 μm, the present embodiment is also applicable to non-magnetic toner and two-component toner as well.

The stirring member 10 includes a supporting rod 10*a* and the sheet member 10*b* (hereinafter also "stirring sheet"). Both ends of the supporting rod 10*a* are supported by the developing container 3*a*, and the center of the supporting rod 10*a* serves as an axis of rotation 10*c*. The supporting rod 10*a* rotates clockwise in FIG. 3, at a rate of approximately one rotation per second in the present embodiment. The stirring sheet used here is a polyphenylene sulfide (PPS) sheet which is 100 μm thick, with one end thereof in the transverse direction being pressure-bonded to the supporting rod 10*a*. The stirring sheet is 210 mm long in the longitudinal direction.

The developing sleeve 8 is formed by coating the surface of an aluminum sleeve, which is a non-magnetic material, with a mid-resistant resin layer. The developing sleeve 8 is disposed at a position facing the surface of the photosensitive drum 1, with both ends of the developing sleeve 8 being rotatably supported by opening portions of the developing device 3. The voltage applying unit 15 is disposed in the image forming apparatus main body and connected to the developing sleeve 8, so as to apply bias at a predetermined timing when printing. A 2000 Hz frequency square wave is applied in the present embodiment at AC voltage Vpp of 1400 V, with DC voltage Vdc of −400 V, when printing.

The magnet roller 8*a*, which is a magnetic field generating member, is disposed within the developing sleeve 8 and has multiple magnetic poles N and S formed alternately. The magnetic polarity constantly faces the same direction, since the magnet roller 8*a* is not rotated but rather held at one constant position.

The developing blade 11 is formed by fixing an urethane rubber blade to a supporting plate by adhesive. The supporting plate is fixed to the developing container 3*a* so as to be in contact with the developing sleeve 8 with a suitable contact pressure, in order to restrict the layer thickness of the toner T to a suitable thickness and to realize triboelectric charging.

Figure 3:
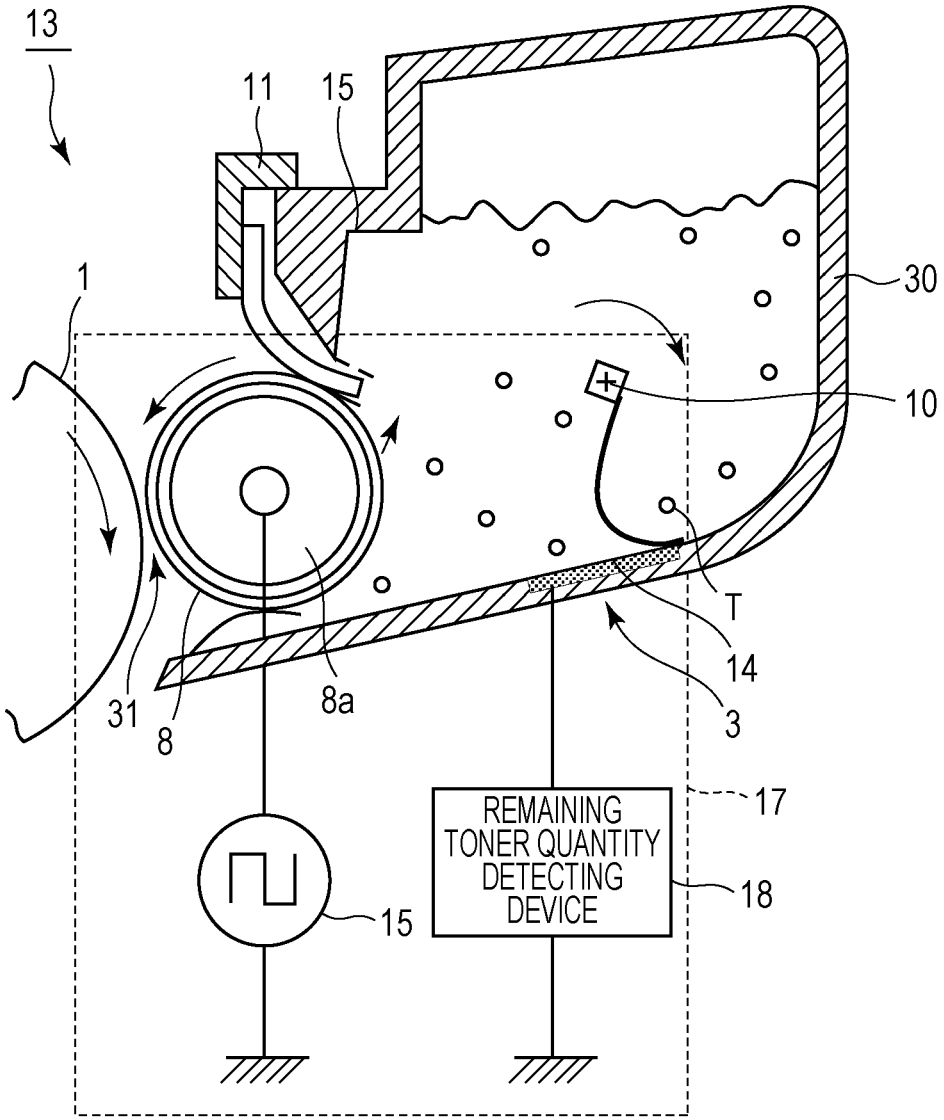
FIG. 3 is a schematic sectional view of a remaining toner quantity detection device according to the first embodiment.

A seal member 3*b* is adhered within the developing container 3*a* to prevent toner leakage when transporting and so forth, such that no toner T leaks out from the region illustrated in FIG. 3.

A conductive resin sheet is used for the antenna member 14 disposed on the inner base portion of the developing container 3*a*. This enables costs to be reduced as compared with a stainless steel plate, which conventionally has been used. The conductive resin sheet used in the present embodiment was formed by dispersing a carbon material in polystyrene resin (hereinafter "PS resin") to secure conductivity. In a case of using magnetic toner, the conductive resin sheet preferably is non-magnetic and has flexibility. Examples of carbon materials which may be used include carbon black, carbon fiber, graphite, and so forth. The resin used is not restricted to PS resin, and ethylene vinyl acetate (EVA) resin or the like may be used instead. EVA resin is incompatible with the high impact polystyrene (HIPS) resin used for the frame, but has adhesiveness and accordingly can be fixed by adhesion. Of course, compatible materials may be used, and generally, materials of the same material quality may be combined and used, or alternatively, materials which are not of the same material quality but are compatible may be combined and used. For example, PS (including HIPS), which is an amorphous resin, is used for the frame material, and similarly amorphous acrylonitrile butadiene styrene (ABS), polyphenylene oxide (PPO), and so forth may be used in combination. The shape of the antenna member 14 is rectangular, having dimensions of 216 mm×15 mm and 200 μm thick. Insert molding is used to fix the antenna member 14 at the time of molding the frame of the developing container 3*a*. The conductive resin sheet is fixed to the mold, and resin is injected, thereby forming integrally. PS resin is used for the material of both the antenna member 14 and developing container 3*a*, so adhesion fixing can be realized at all contact faces as to the frame of the developing container 3*a*, including at the side faces of the antenna member 14.

The present embodiment realizes reduction in cost by replacing the electrode from a stainless steel plate to a conductive resin sheet. Using a conductive resin sheet for the electrode plate reduces adhesion of toner to the electrode plate even if magnetic toner is used, which can reduce degradation in accuracy of residual toner detection. The conductive resin sheet is preferably attached to an inner wall of the developing container 3*a*, so as to not obstruct transportation and circulation of toner.

A developing container also is normally provided with a stirring member to transport toner. The stirring member has an axis of rotation parallel to the developer bearing member, and transports the toner by rotating the flexible stirring sheet. Further, transporting as much toner as possible is often attempted by rotating the stirring sheet in contact with the inner walls of the developing container.

For example, there are cases where the conductive resin sheet serving as the electrode plate is fixed on the inner wall of the developing container, and the flexible stirring sheet serving as the stirring member may partially come into contact with the electrode plate. These cases sometimes create a new problem.

For example, the conductive resin sheet may be applied to the inner wall of the developing container using two-sided adhesive tape. If the image forming apparatus configured thus is used for a long time, the number of times of the stirring sheet coming into contact with the conductive resin sheet increases, so eventually the conductive resin sheet may come loose or be damaged. The conductive resin sheet has a side face on the upstream side thereof in the direction of rotation of the stirring member. The edge of the stirring sheet coming into contact with the side face of the conductive resin sheet when rotating is what causes the conductive resin sheet to possibly come loose or be damaged.

If the conductive resin sheet comes loose or is damaged, the capacitance cannot be accurately measured, so remaining toner quantity detection accuracy decreases.

Accordingly, if at least the one side face of the conductive resin sheet, which is the antenna member 14, situated on the upstream side thereof in the direction of rotation of the stirring member 10 is fixed to at least the frame of the container, coming loose can be reduced.

Also, forming the inner wall of the developing container 3*a* such that a step is formed to make the downstream side lower as compared to the upstream side in the direction of rotation of the stirring member 10, can achieve the same results.

Thus, the conductive resin sheet used for detection in the capacitance detection method coming loose or being damaged can be reduced. Accordingly, the remaining toner quantity detection accuracy can be prevented from dropping due to the antenna member coming loose or being damaged.

In the present embodiment, the front edge of the sheet member 10*b* of the stirring member 10 can come into contact 14*c* with the conductive resin sheet which is the antenna member 14. Accordingly, toner upon the antenna member 14 can be conveyed to near the developing sleeve 8 even if the remaining amount of toner is small. Further, there is no uneven toner residual upon the antenna member 14, so this configuration is advantageous from the perspective of remaining toner quantity detection accuracy. Accordingly, the stirring sheet according to the present embodiment is arranged to come into contact with the entirety of the face 14*b* of the antenna member 14 facing the stirring axis (the aforementioned axis of rotation 10*c*), from the upstream edge to the downstream edge in a lateral direction of the antenna member.

According to the above-described configuration, toner T near the developing sleeve 8 is supplied to the surface of the developing sleeve 8 by the magnetic field of the magnet roller 8*a*. Thereafter, the layer thickness of the toner T on the developing sleeve 8 is optimized by the developing blade 11, and charged by friction charging. The charged toner T is visualized as an electrostatic latent image on the photosensitive drum 1, at a developing region 31.

While description has been made regarding a developing device, the described exemplary embodiment(s) may also be applied to a developer container accommodating developer, and used to detect the amount of developer. In this case, the container will not have the developing sleeve serving as a developer bearing member.

Description of Remaining Developer Quantity (Remaining Toner Quantity) Detection Unit Next, the remaining toner quantity detection unit 17 used in the present embodiment, which uses change in capacitance value, will be described with reference to FIG. 3.

The remaining toner quantity detection unit 17 in the present embodiment includes the voltage applying unit 15 which applies bias to the electrode, the developing sleeve 8 which is an electrode, the antenna member 14 which is a facing electrode, and a remaining developer quantity detecting device (hereinafter also referred to as remaining toner quantity detecting device) 18.

The conductive resin sheet serving as the antenna member 14 is disposed so as to contact a contact point (not shown) which is situated at the near side of the paper and at the base of the developing container 3*a*, so as to be grounded via the remaining toner quantity detecting device 18 which is disposed in the image forming apparatus.

In this configuration described above, the remaining toner quantity detecting device 18 can detect capacitance between the developing sleeve 8 and the antenna member 14 when bias is applied to the developing sleeve 8 by the voltage applying unit 15. At this time, the greater amount of toner there is between the electrodes, the greater the detected capacitance is, since the relative permittivity of toner is greater than that of air.

Note that the capacitance value changes as the toner moves due to the stirring member 10 rotating, so the capacitance value used is an average of output values for one cycle of the stirring member 10. Note that consecutive capacitance detection is performed according to this configuration of the present embodiment, where capacitance is consecutively detected while printing.

Calculation Method of Developer Quantity (Toner Quantity)

Next, a method of calculating, of the developer quantity (hereinafter, "toner quantity"), the remaining developer quantity (hereinafter, "remaining toner quantity") will be described with reference to FIG. 5.

Figure 5:
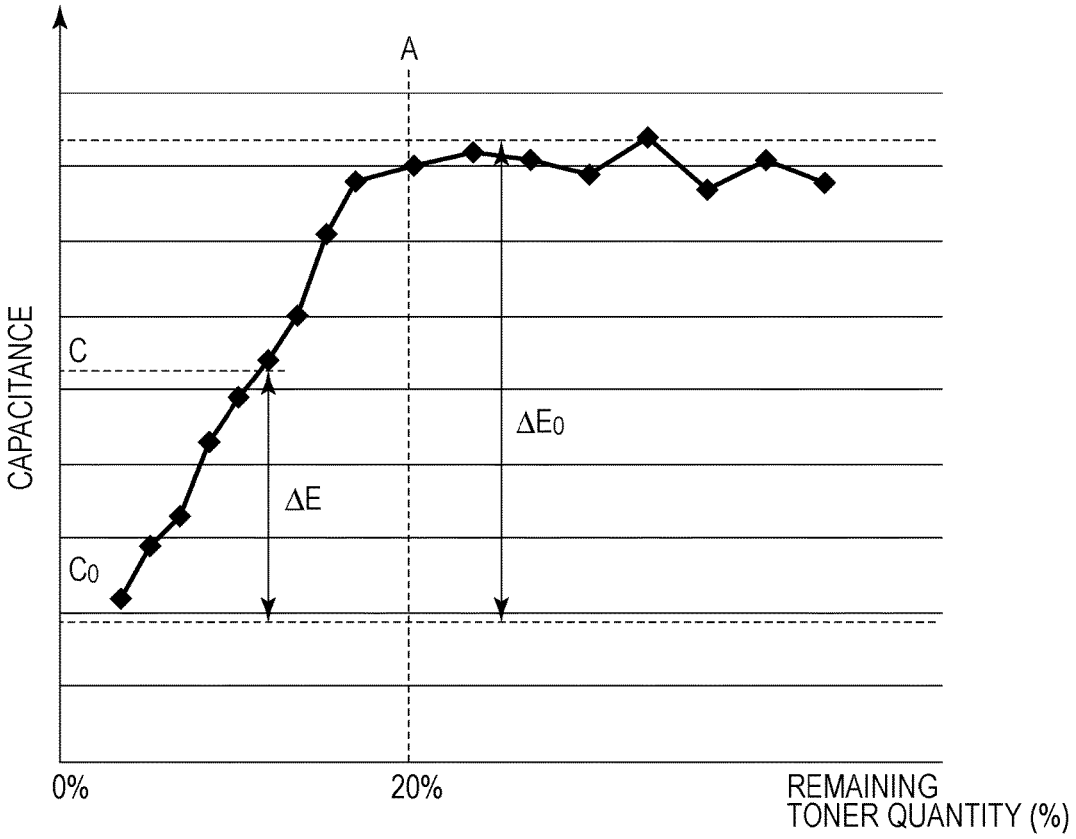
FIG. 5 is a relation diagram illustrating remaining toner quantity and capacitance, according to the first embodiment.

FIG. 5 is a relational diagram illustrating the relation between remaining toner quantity and capacitance according to the present exemplary embodiment. The vertical axis represents the capacitance detected by the remaining toner quantity detection unit 17, and the horizontal axis represent the remaining toner quantity. From an initial state (toner full, 100%) to 20% (dotted line A), there is no change in capacitance, since there is sufficient toner left and the toner quantity between the developing sleeve 8 and the antenna member 14 does not change. When the remaining toner quantity drops below 20%, the capacitance also linearly decreases as the remaining toner quantity decreases. This changes as the toner quantity between the developing sleeve 8 and the antenna member 14 changes.

$\Delta E_0$ represents the difference between capacitance $C_0$ in a state where there is no toner between the developing sleeve 8 and the antenna member 14, and capacitance in a full toner quantity (100%) state through 20% state. Also, $\Delta E$ represents the difference between capacitance C which is output as the average capacitance during printing of one image, and the capacitance $C_0$ in a state where there is no toner between the developing sleeve 8 and the antenna member 14. Accordingly, the current remaining toner quantity is calculated by the following Expression (1).

$$\text{Current remaining toner quantity} = 20\% \times \Delta E / \Delta E_0 \qquad \text{Expression (1)}$$

The detected results are notified to the user by displaying on a display unit (not shown) on the image forming apparatus or a monitor (not shown) of a personal computer.

Configuration of Comparative Example 1

The comparative example 1 differs in configuration from the first embodiment with regard to the method by which the antenna member 14 is fixed to the developing container 3*a*.

Figure 1A:
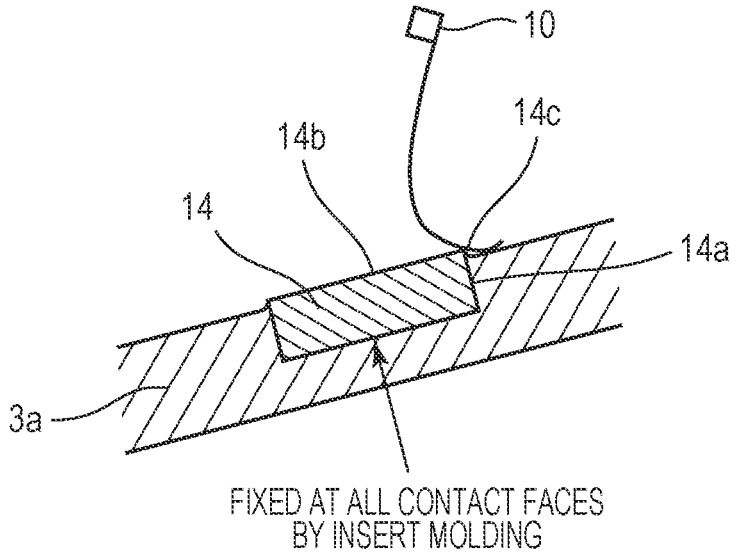
FIGS. 1A and 1B are enlarged sectional views around an antenna member according to a first embodiment and a comparative example 1.
Figure 1B:
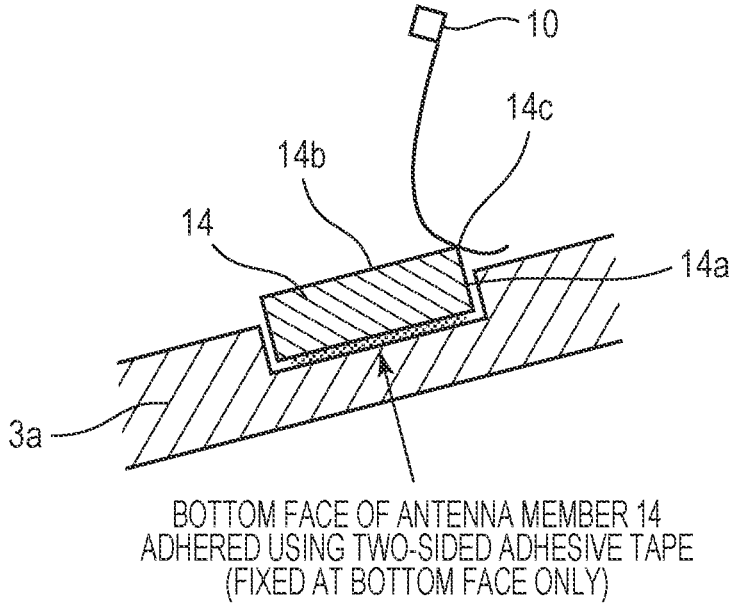

FIGS. 1A and 1B are enlarged sectional views around an antenna member 14 according to a first embodiment and a comparative example 1, respectively. The side faces of the antenna member 14 are fixed by adhesion to the developing container 3*a* in the configuration according to the first embodiment, as illustrated in FIG. 1A. On the other hand, the bottom face of the antenna member 14 is applied to a recess on an inner wall of the developing container 3*a* by two-sided adhesive tape in the comparative example 1. Accordingly, the side faces of the antenna member 14 are not adhered to the developing container 3*a* in comparative example 1, and the stirring sheet will come into contact with the side face of the antenna member 14 while rotating in this configuration. Otherwise, the comparative example 1 is the same as the first embodiment.

Comparison of Endurance Tests Between First Embodiment and Comparative Example 1

An endurance test of 20,000 sheets was performed until blank areas due to toner having run out occurred, with the configurations of the present embodiment and the comparative example 1. Comparison of remaining toner quantity detection accuracy was performed while confirming the state of the antenna member 14 regarding coming loose and being damaged over the course of this endurance test. First, state of the antenna member 14 coming loose and being damaged is illustrated in Table 1.

TABLE 1

Comparison of State of Antenna Member Between First Embodiment and Comparative Example 1

| | 0 copies | 5000 copies | 10000 copies | 15000 copies | 20000 copies |
|---|---|---|---|---|---|
| First Embodiment | G | G | G | G | G |
| Comparative Example 1 | G | G | G | P | U |

G (good) means no occurrence, P (poor) means antenna coming loose, and U (unacceptable) means antenna damaged.

As can be seen from Table 1, the configuration according to the present embodiment exhibited no problems, but the configuration according to the comparative example 1 exhibited the antenna member 14 coming loose and being damaged beyond 15,000 copies. The term "coming loose" as used here means part of the two-sided adhesive tape adhering the antenna member 14 to the developing container 3*a* coming loose, so that part of the antenna member 14 is peeled upwards each time the stirring sheet comes into contact therewith. The term "damage" means part of the antenna member 14 being damaged.

The fact that there was no coming loose or damage in the configuration according to the first embodiment is due to the method of fixing the antenna member 14 to the developing container 3*a*. The side faces of the antenna member 14 are fixed by adhesion to the developing container 3*a* in the present embodiment, and thus is a configuration where coming loose and damage due to rubbing by the stirring sheet do not readily occur. On the other hand, simple adhesion of the base face of the antenna member 14 by two-sided adhesive tape as with the comparative example 1 does not afford the withstanding strength as to repeated rubbing by the stirring sheet that the first embodiment does. It is thus conceived that the antenna member 14 was peeled up from the side face and suffered damage during the endurance test.

The insert molding used in the present embodiment involves all regions of the side faces 14*a* of the antenna member 14 being fixed to the developing container 3*a*, but this arrangement is not seen to be limiting. A configuration may be made where at least part of the conductive resin sheet is embedded in the frame so as to be fixed. The greater the area of the side faces 14*a* of the antenna member 14 fixed, the stronger the configuration is as to coming loose and being damaged. Specifically, 80% or more of the area of the side faces is fixed. Also, in terms of the length of the side faces in the thickness direction, the conductive resin sheet does not readily come loose if 80% or more of the length thereof is fixed to the side face of the container. That is to say, advantages of the present disclosure are exhibited to a certain extent even if part is not fixed. However, it can be said that a configuration where the side face regions of the antenna member 14 are maximally fixed to the frame of the container is preferable.

As can be seen from the endurance test, a configuration where the conductive resin sheet is fixed by the base face thereof to the container using both-sided adhesive tape, as in comparative example 1, is useful for a model which will make up to around 10,000 copies. However, in a case of printing a greater number, the configuration of the present embodiment is more preferable.

Figure 6:
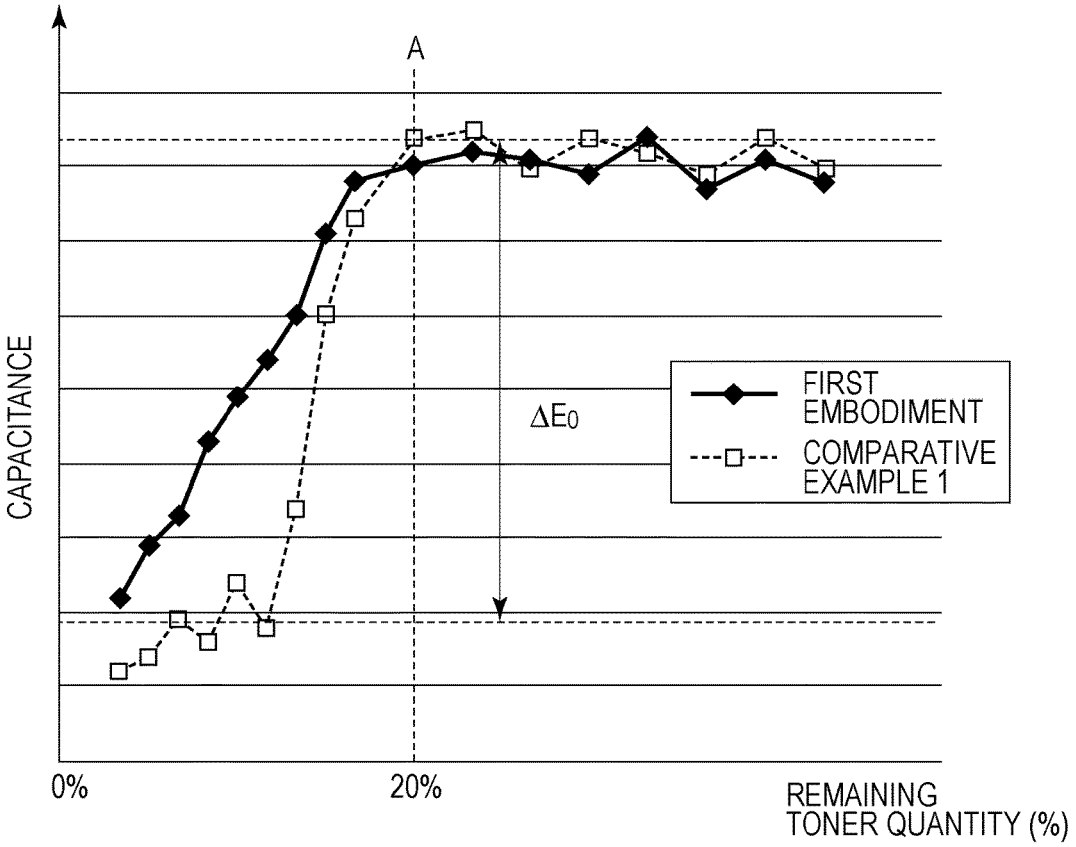
FIG. 6 is a relation diagram illustrating remaining toner quantity and capacitance, according to the first embodiment and the comparative example 1.

Next, transition of remaining toner quantity output during the endurance test is illustrated in FIG. 6. In the case of the present embodiment, 0% remaining toner quantity was detected immediately before white regions were observed due to the toner having run out, meaning that remaining toner quantity detection was successful. However, remaining toner quantity output varied in the configuration according to comparative example 1, and 0% remaining toner quantity was detected long before white regions were observed due to the toner having run out.

This will be described using capacitance C, area S, interval d, and permittivity ε, in relational expression $C=\varepsilon S/d$. First, from the point that the conductive resin sheet serving as the antenna member 14 begins to come loose, each time part of the conductive resin sheet comes loose the distance d between the developing sleeve 8 and the antenna member 14 is shortened. This means that a greater capacitance C is output even though the remaining toner quantity is the same, resulting in a greater remaining toner quantity output.

Also, in a case of the conductive resin sheet being bent and damaged, the area S of the antenna is reduced, which means that a smaller capacitance C is output even though the remaining toner quantity is the same, resulting in a smaller remaining toner quantity output. Accordingly, 0% remaining toner quantity is detected long before white regions occur due to the toner running out.

As can be seen from this endurance test as well, a configuration where the conductive resin sheet is fixed by the base face thereof to the container using both-sided adhesive tape, as in comparative example 1, is useful for a model which will make up to around 10,000 copies. However, in a case of printing in greater numbers, the configuration of the present embodiment is more preferable.

As described above, the antenna member 14 can be prevented from coming loose or being damaged, by fixing the side faces of the antenna member 14 to the developing container 3*a* or frame by insert molding. Thus, lowering remaining toner quantity detection accuracy due to the antenna member 14 having come loose or being damaged can be reduced.

Second Embodiment

Figure 7:
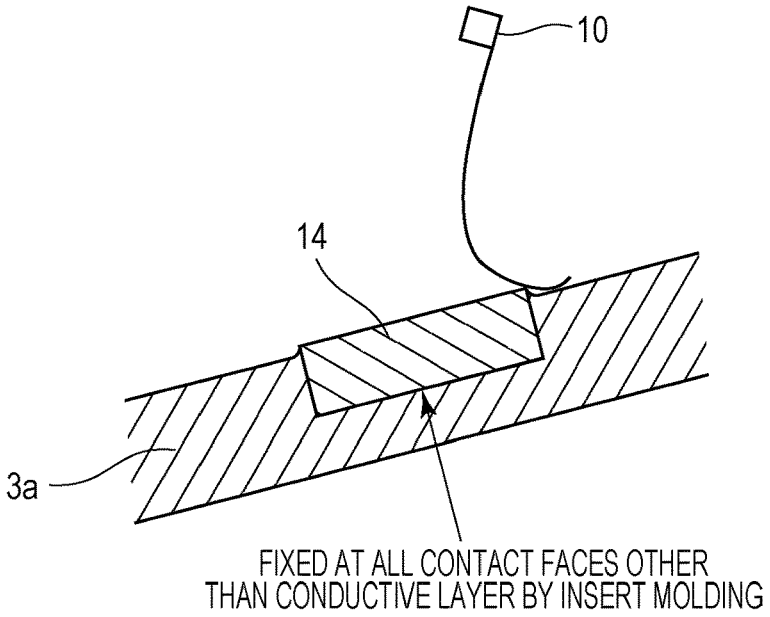
FIG. 7 is an enlarged sectional view around an antenna member 14 according to a second embodiment.

In a second embodiment, the conductive resin sheet serving as the antenna member 14 has a three-layer structure. The three-layer structure according to the present embodiment will be described with reference to the enlarged sectional view in FIG. 7. First, two layers of the three layers are PS resin layers 100 μm thick each, functioning as compatibility layers during insert molding. The other layer is a 50-μm thick urethane resin layer with carbon dispersed therein, sandwiched between the two PS resin layers so as to serve as a conductive layer. The two PS resin layers also serve as protective layers for the conductive layer.

Also, the conductive resin sheet is fixed to the developing container 3*a* in the same way as with the first embodiment, at the time of molding using insert molding. PS resin is used for the developing container 3*a*, and thus the developing container is compatible with the two PS resin layers of the three layers of the antenna member 14. Accordingly, the developing container 3*a* and antenna member 14 are adhered to each other at PS resins of each other in the present embodiment illustrated in FIG. 7, and also adhered at the side faces of the antenna member 14. Other configurations are the same as with the first embodiment.

This antenna member 14 also prevents the antenna member 14 from coming loose or being damaged. Detailed results are described next.

Configuration of Comparative Example 2

The comparative example 2 is configured in the same way as the comparative example 1 described in the first embodiment. Accordingly, description thereof will be omitted.

Comparison of Endurance Tests Between Second Embodiment and Comparative Example 2

An endurance test of 20,000 sheets was performed until blank areas due to toner having run out occurred, with the configurations of the second embodiment and the comparative example 2. Comparison of remaining toner quantity detection accuracy was performed while confirming the state of the antenna member 14 regarding coming loose and being damaged over the course of this endurance test. First, state of the antenna member 14 coming loose and being damaged is illustrated in Table 2.

TABLE 2

Comparison of State of Antenna Member Between Second Embodiment and Comparative Example 2

| | 0 copies | 5000 copies | 10000 copies | 15000 copies | 20000 copies |
|---|---|---|---|---|---|
| Second Embodiment | G | G | G | G | G |
| Comparative Example 2 | G | G | G | P | U |

G (good) means no occurrence, P (poor) means antenna coming loose, and U (unacceptable) means antenna damaged.

As can be seen from Table 2, the configuration according to the present embodiment exhibited no problems, but the configuration according to the comparative example 2 exhibited the antenna member 14 coming loose and being damaged beyond 15,000 copies.

The fact that there was no coming loose or damage in the configuration according to the second embodiment is due to the method of fixing the antenna member 14 to the developing container 3*a* being different. The side faces of the antenna member 14 are fixed by adhesion to the developing container 3*a* in the present embodiment, by insert molding, and thus is a configuration where coming loose and damage due to rubbing by the stirring sheet do not readily occur. On the other hand, simple adhesion of the base face of the antenna member 14 by two-sided adhesive tape as with the comparative example 2 does not afford the withstanding strength as to repeated rubbing by the stirring sheet that the second embodiment does. The antenna member 14 was thus peeled up from the side face and suffered damage during the endurance test.

Transition of remaining toner quantity during the endurance test was generally the same as that illustrated in FIG. 6 in the first embodiment. In the case of the second embodiment, 0% remaining toner quantity was detected immediately before white regions were observed due to the toner having run out, meaning that remaining toner quantity detection was successful. However, in the configuration according to comparative example 2, 0% remaining toner quantity was detected long before white regions were observed due to the toner having run out, so the number of copies which can be printed in a case of using the comparative example 2 is smaller.

As described above, even in a case where the antenna member 14 has a three-layer structure as with the present embodiment, the antenna member 14 can be prevented from coming loose or being damaged, by fixing the side faces of the antenna member 14 to the developing container 3*a* or frame by insert molding. Thus, lower remaining toner quantity detection accuracy due to the antenna member 14 having come loose or being damaged can be reduced.

While description has been made in the present embodiment regarding a configuration where the antenna member 14 has a three-layer structure, the antenna member 14 may be formed of two layers, or four or more layers. In this case, the side faces of the antenna member 14 can be fixed by adhesion to the side faces of the frame if at least the topmost layer, which comes in contact with the stirring sheet, is compatible. Accordingly advantages the same as those of the present embodiment can be had.

Third Embodiment

A third embodiment relates to the way in which the antenna member 14 and the developing container 3*a* are laid out, unlike the first and second embodiments.

Figure 8:
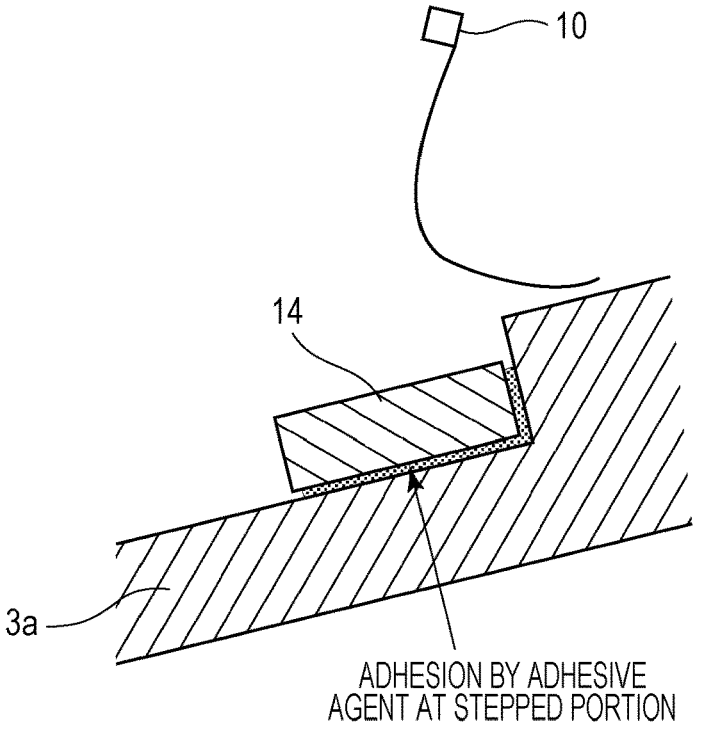
FIG. 8 is an enlarged sectional view around the antenna member 14 according to the third embodiment.

FIG. 8 illustrates an enlarged sectional view around the antenna member 14, according to the present embodiment. The developing container 3*a* is formed such that the downstream side in the direction of rotation of the stirring member 10 is lower than the upstream side, as illustrated in FIG. 8. It is a feature of the present embodiment that the antenna member 14 is placed abutted at this stepped portion, and fixed using an adhesive agent.

The method of adhesion is not restricted to application using adhesive agent, and may be insert molding. Alternatively, hot-melt adhesive may be used for adhesion, such that the hot-melt adhesive flows toward the antenna member 14 from the upstream direction thereof. Otherwise, the configuration of the third embodiment is the same as that of the first embodiment.

According to the configuration of the present embodiment, the effects of preventing the antenna member 14 from coming loose or being damaged due to repetitive rubbing by the stirring sheet are improved over the first and second embodiments. The reason is that there is no contact at all between the stirring sheet and the side face of the antenna member 14 due to the stepped shape.

The results of confirmation of the advantages by endurance test, and transition of remaining toner quantity output are the same as with the first embodiment, so description will be omitted. According to the configuration of the present embodiment, lower remaining toner quantity detection accuracy due to the antenna member 14 having come loose or being damaged can be reduced.

Figure 4A:
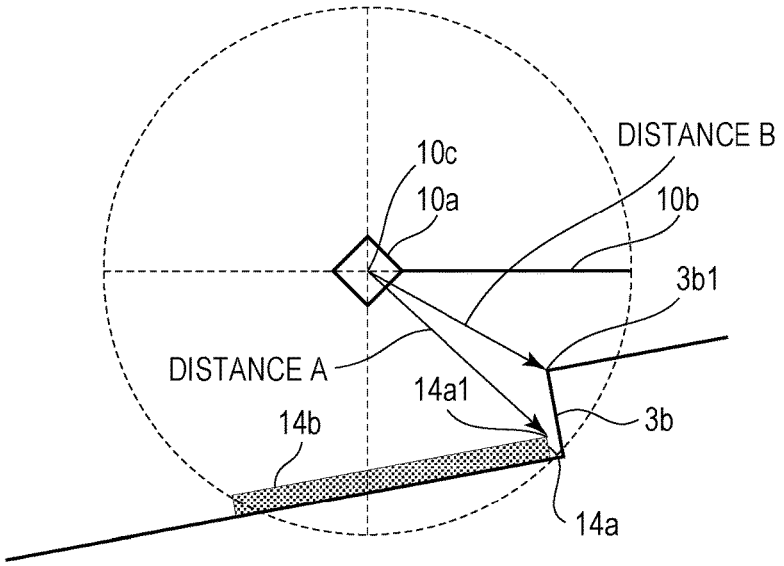
FIGS. 4A and 4B are diagrams illustrating the relation between a conductive resin sheet and a developer container frame, according to a third embodiment.

This will be described in further detail with reference to FIGS. 4A and 4B. FIG. 4A illustrates a configuration where there a first side face 14*a* of the conductive resin sheet situated on the upstream side in the direction of rotation of the stirring member 10, and a second side face 3*b* of the developing container 3*a*, face each other. FIG. 4A illustrates a distance A from the stirring axis 10*c* of the stirring member 10 to a first side face portion 14*a*1, which is the closest, and a distance B from the stirring axis 10*c* of the stirring member 10 to a second side face portion 3*b*1, which is the closest. In this design, the distance A and distance B are the same, or the distance A is longer than the distance B.

Figure 4B:
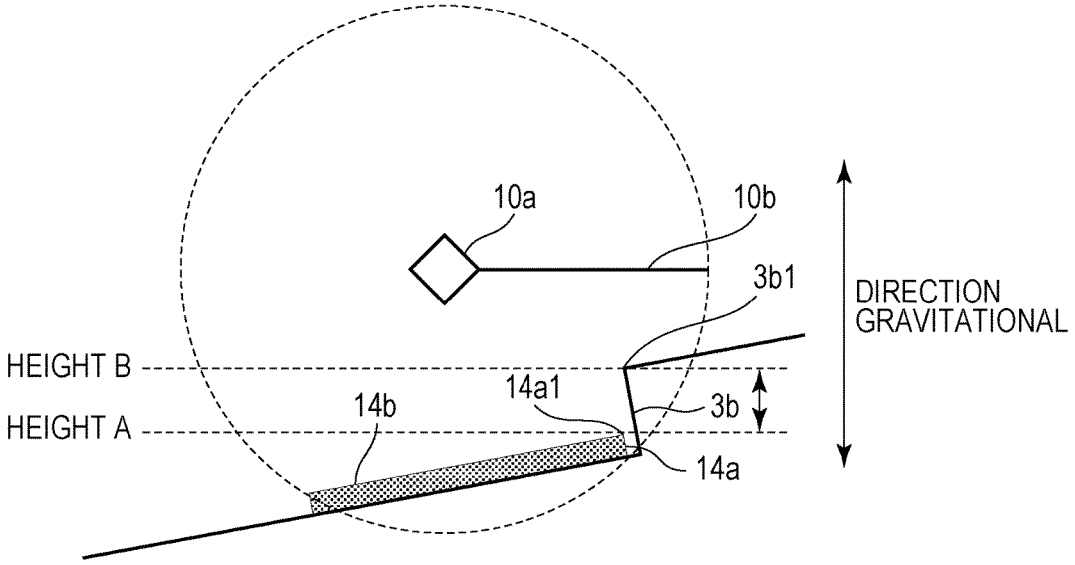

From a different perspective, a configuration such as illustrated in FIG. 4B may be made. A feature of the configuration illustrated in FIG. 4B is the attitude of the developing device 3 when in use. With regard to a height A of the face 14*b* of the conductive resin sheet facing the stirring axis in the gravitational direction, and a height B of a face of the frame facing the stirring axis at a position adjacent to the conductive resin sheet, the height A and height B are the same height, or the height A is lower than the height B, as can be seen from FIG. 4B.

These arrangements exhibit a certain level of advantages even if the side faces of the conductive resin sheet is not adhered to the frame, as illustrated in FIGS. 4A and 4B.

As described above, costs can be reduced by using a conductive resin sheet for capacitance detection instead of a stainless steel sheet. Specific configurations enable lower remaining toner quantity detection accuracy, due to the conductive resin sheet having come loose or being damaged, to be reduced.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-197217, filed Sep. 24, 2013, which is hereby incorporated by reference herein in its entirety.

What is claimed is:

1. A developer container configured to accommodate magnetic developer, the developer container comprising:

a stirring member having a stirring shaft and a stirring sheet, and configured to stir the developer; and a conductive resin sheet disposed on an inside wall of the developer container so as to come into contact with the stirring sheet when the stirring member rotates and configured to be used for detecting developer quantity by using capacitance, where the conductive resin sheet includes at least one of carbon black, carbon fiber and graphite, and wherein at least part of an upstream side face of the conductive resin sheet in a direction of rotation of the stirring member is fixed to a side face of the developer container facing the upstream side face.

2. The developer container according to claim 1, further comprising:

a frame having the conductive resin sheet, wherein a height of a face of the conductive resin sheet facing the stirring axis in a gravitational direction when in use, is the same height as or lower than a height of a face of the frame facing the stirring axis, at a position where the conductive resin sheet and frame are adjacent.

3. The developer container according to claim 1, further comprising:

a frame, wherein at least a part of the conductive resin sheet has been embedded in the frame.

4. The developer container according to claim 1, wherein resin used for the conductive resin sheet is ethylene vinyl acetate (EVA).

5. The developer container according to claim 1, wherein 80% or more of an area of the side face of the conductive resin sheet in a thickness direction is fixed to the developer container.

6. The developer container according to claim 1, wherein 80% or more of an area of the side face of the conductive resin sheet is fixed to the developer container.

7. A developing device comprising: the developer container according to claim 1; and a developer bearing member configured to bear developer.

8. A process cartridge comprising: the developer container according to claim 1; and an image bearing member configured to bear a developer image.

9. An image forming apparatus comprising: the developer container according to claim 1; and a transfer unit configured to transfer a developer image on a transfer medium.

10. The developer container according to claim 1, where the conductive resin sheet is disposed on an inside wall of the developer container by insert molding.

11. A developer container configured to accommodate magnetic developer, the developer container comprising:

a stirring member having a stirring shaft and a stirring sheet, and configured to stir the developer in the developer container; and a conductive resin sheet disposed on an inside wall of the developer container so as to come into contact with the stirring sheet when the stirring member rotates and configured to be used for detecting developer quantity by using capacitance, where the conductive resin sheet includes at least one of carbon black, carbon fiber and graphite, wherein a first side face, which is a side face of the conductive resin sheet situated on the upstream side thereof in a direction of rotation of the stirring member, and a second side face, which is a side face of the developer container, are provided facing one another, wherein the first side face has a first side face end portion with respect to a thickness direction of the conductive resin and the second side face has a second side face end portion with respect to a thickness direction of the conductive resin, and wherein a distance from the first side face end portion to an axis of the stirring shaft, is the same distance or longer than a distance from the second side face end portion to the axis of the stirring shaft.

12. The developer container according to claim 11, wherein at least part of the first side face is fixed to the second side face.

13. The developer container according to claim 11, wherein resin used for the conductive resin sheet is ethylene vinyl acetate (EVA).

14. A developing device comprising: the developer container according to claim 11; and a developer bearing member configured to bear developer.

15. A process cartridge comprising: the developer container according to claim 11; and an image bearing member configured to bear a developer image.

16. An image forming apparatus comprising: the developer container according to claim 11; and a transfer unit configured to transfer a developer image on a transfer medium.

17. The developer container according to claim 11, where the conductive resin sheet is disposed on an inside wall of the developer container by insert molding.

18. A developer container configured to accommodate developer, the developer container comprising:

a stirring member having a stirring shaft and a stirring sheet, and configured to stir the developer in the developer container; and a conductive resin sheet disposed on an inside wall of the developer container so as to come into contact with the stirring sheet when the stirring member rotates and configured to be used for detecting developer quantity by using capacitance, where the conductive resin sheet and the developer container include a same resin, and wherein at least part of an upstream side face of the conductive resin sheet in a direction of rotation of the stirring member is fixed to a side face of the developer container facing the upstream side face.

19. The developer container according to claim 18, wherein at least one of carbon black, carbon fiber and graphite is dispersed in the conductive resin.

20. The developer container according to claim 18, where the conductive resin sheet is disposed on an inside wall of the developer container by insert molding.

21. A developer container configured to accommodate developer, the developer container comprising:

a stirring member having a stirring shaft and a stirring sheet, and configured to stir the developer in the developer container; and a conductive resin sheet disposed on an inside wall of the developer container so as to come into contact with the stirring sheet when the stirring member rotates and configured to be used for detecting developer quantity by using capacitance, wherein a first side face is a side face of the conductive resin sheet situated on the upstream side thereof in a direction of rotation of the stirring member, wherein a second side face is a side face of the developer container situated on the upstream side of the conductive resin sheet in the direction of rotation of the stirring member and in a direction of conveying the developer toward an opening of the developer container, wherein the first side face and the second side face are provided facing each other, wherein the first side face has a first side face end portion which is a closest portion to an axis of the stirring shaft among the first side face with respect to a thickness direction of the conductive resin, wherein the second side face has a second side face end portion which is a closest portion to the axis of the stirring shaft among the second side face with respect to a thickness direction of the conductive resin, and wherein a distance from the first side face end portion to an axis of the stirring shaft is longer than a distance from the second side face end portion to the axis of the stirring shaft.

22. The developer container according to claim 21, wherein at least one of carbon black, carbon fiber and graphite is dispersed in the conductive resin sheet.

23. The developer container according to claim 21, where the conductive resin sheet is disposed on an inside wall of the developer container by insert molding.

* * * * *